US006912739B1

(12) United States Patent
Nowell

(10) Patent No.: US 6,912,739 B1
(45) Date of Patent: Jul. 5, 2005

(54) SAFETY INLET ASSEMBLY FOR POOL DRAINS

(76) Inventor: Richard Nowell, 6700 Highway 39N, Selma, NC (US) 27526

( * ) Notice: Subject to any disclaimer, the term of this patent is extended or adjusted under 35 U.S.C. 154(b) by 0 days.

(21) Appl. No.: 10/727,469

(22) Filed: Dec. 4, 2003

(51) Int. Cl.[7] ..... E04H 4/00
(52) U.S. Cl. ..... 4/507; 210/169
(58) Field of Search ..... 4/507–509; 210/169

(56) References Cited

U.S. PATENT DOCUMENTS 4,921,600 A * 5/1990 Meissner ..... 210/169
5,830,350 A * 11/1998 Voss et al. ..... 210/169
2003/0213058 A1 * 11/2003 Arp et al. ..... 4/508

* cited by examiner

*Primary Examiner*—Charles E. Phillips
(74) *Attorney, Agent, or Firm*—Mills Law Firm PLLC

(57) ABSTRACT

A safety inlet drain assembly for main and skimmer drains of a swimming pool includes a perforated cylinder in the drain cavity mounted at a lower end on the drain return line and having a domed cap on the upper end to which the drain gate cover is attached by fasteners. The safety drain assembly is configured for precluding complete blockage by pool users in the event of displacement of the cover plate thereby preventing excessive suction conditions otherwise posing physical danger to the users.

9 Claims, 5 Drawing Sheets

SAFETY INLET ASSEMBLY FOR POOL DRAINS

FIELD OF THE INVENTION

The present invention relates to pool drains, and, in particular, to main and skimmer drains for swimming, wading, and circulating pools incorporating safety devices for preventing inadvertent blockage by pool users.

BACKGROUND OF THE INVENTION

Swimming and wading pools, as well as certain spas, are equipped with powerful water circulation filtration systems. Such pools use one or more drains in the pump return line that generate high flow, high suction conditions at their inlets. It is now recognized that such drain conditions can pose considerable risks to pool users, particularly children. The drain conditions can entrap swimmers, resulting in numerous reported annual drownings as a result of an inability to break free of the extreme suction condition. Hair and apparel may also be entangled in the drain, resulting in traumatic and physically dangerous situations. Disembowelments have also been reported.

As a result of these repetitive accidents, many jurisdictions have enacted regulations to obviate the prime causal factors. To limit suction conditions in the event of blockage, plural drains have been proposed. To limit local suction conditions at a particular drain, anti-vortex covers and grated openings have been required. Maximum pump suction conditions have also been specified. During use, however, the covers and openings may become dislodged and the protective features are lost. Accordingly, even the currently proposed circulation conditions do not entirely overcome acute suction conditions at the drain inlet.

Most of such regulatory approaches have focused on new installations, or conditioned approval of alterations to the installations on retrofitting the drainage system for compliance. The economics of retrofit have limited the use of these approaches in existing pool installations where the governmental control is not applicable.

BRIEF SUMMARY OF THE INVENTION

The present invention provides a safety inlet assembly that may be readily and inexpensively incorporated into existing suction drains for pools, spas and other water circulation facilities and limits suction conditions. The safety inlet assembly is adapted for use with existing main and skimmer drain designs, requiring only conventional couplings. The inlet assembly comprises a domed perforated tube having a lower mounting collar that attached with the coupling to the drain inlets. The drain cover is attached to the tube. Should the cover become dislodged, the tube provides a three dimensional hole array that eliminate high suction conditions even if the hole pattern is partially obstructed. The inlet assembly in one embodiment utilizes telescoping tubes providing protective redundancy in the event a tube and associated cover are dislodged.

Accordingly, it is an object of the present invention to provide a flow control device for swimming pool suction drains that may be inexpensively and readily installed into existing pools.

Another object is to provide a suction inlet drain with an auxiliary device that limits drain suction conditions if the drain cover is dislodged.

A further object of the invention is to provide a drain safety device that can be adapted to existing pool installations using easy to obtain components.

DESCRIPTION OF THE DRAWINGS

The above and other objects and advantages of the present invention will become apparent upon reading the following detailed description, taken in conjunction with the accompanying drawings in which.

DETAILED DESCRIPTION OF THE PREFERRED EMBODIMENT

Figure 1:
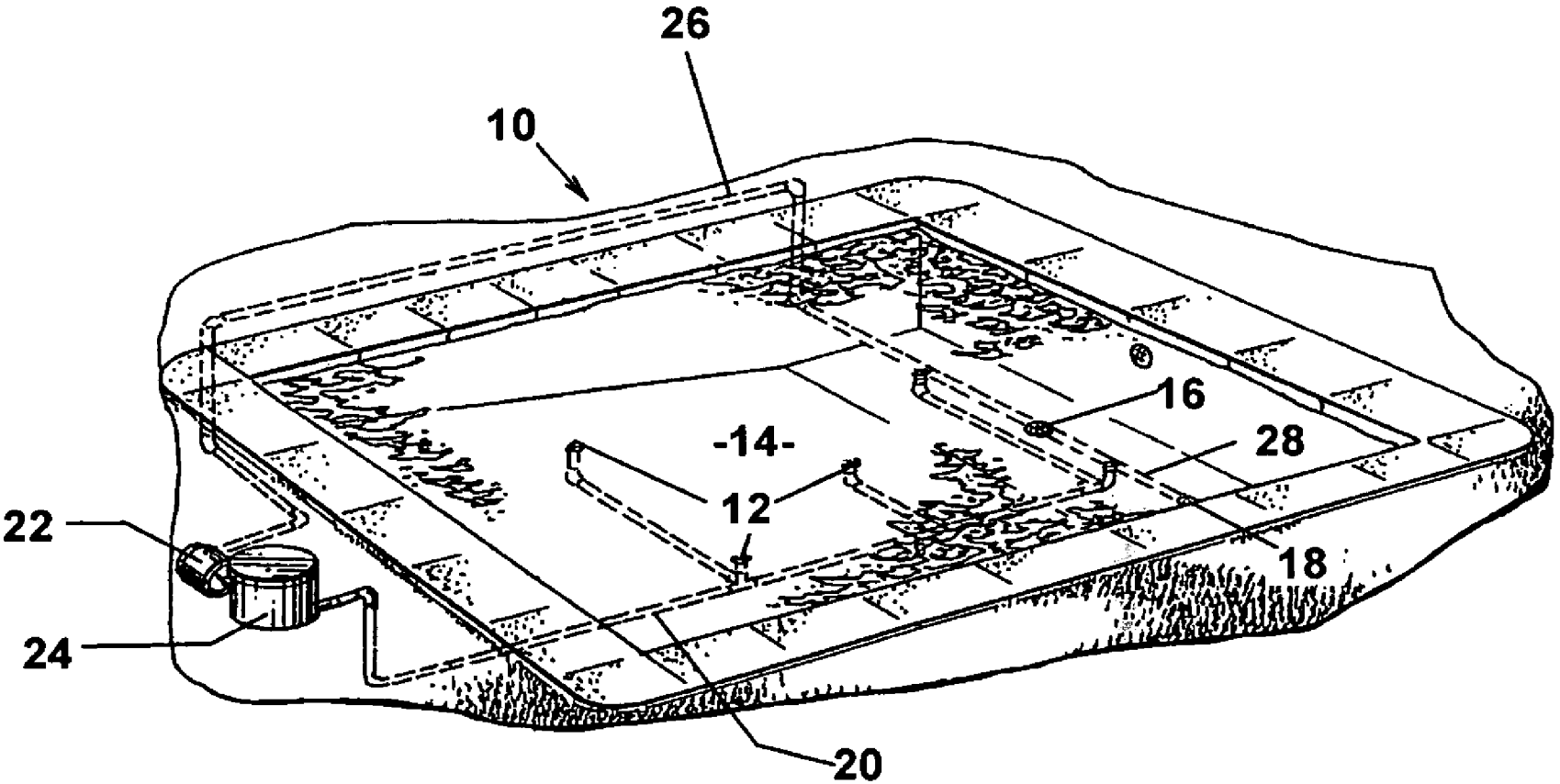
FIG. 1 is a top view of a swimming pool incorporating safety inlet drain assemblies in accordance with the invention.

Referring to the drawings for the purpose of illustrating a preferred embodiment of the invention and not for limiting same, FIG. 1 shows a swimming pool 10 having a plurality of water supply outlets 12 around the base 14 for circulating water to the pool, and a main drain 16 and a skimmer drain 18 for returning water from the pool 10.

The outlets 12 are serially connected by an outlet conduit 20 in a supply line from a pump 22 and a filter 24. The main drain 16 is connected by main conduit 26 in a return line to the pump 22. The skimmer drain 18 is connected with the main drain 16 by branch conduit 28. Conventionally the main drain 16 is located at the deepest portion of the pool and centrally thereof. The skimmer drain 18 may be deployed in varying modes. The skimmer drain may be integrated into the sidewalls of the pool for straining upper level debris. The skimmer drain may also be employed as a floating device and coupled to the branch conduit by a flexible hose. In the latter case, the skimmer drain may be used during normal pool usage. Additionally, the skimmer drain may be used in conjunction with a pool cover for removing accumulated water and debris during off-season periods.

As illustrated in the preferred embodiment, the skimmer drain 18 is connected in series with the main drain 16 to provide a secondary inlet to the pump in the event the main drain 16 is obstructed, both as a personnel and a mechanical safety measure. Moreover, particularly in older installations, the skimmer drain may be connected in parallel with the main drain 16. The present invention is compatible with all of the foregoing variants.

Figure 2:
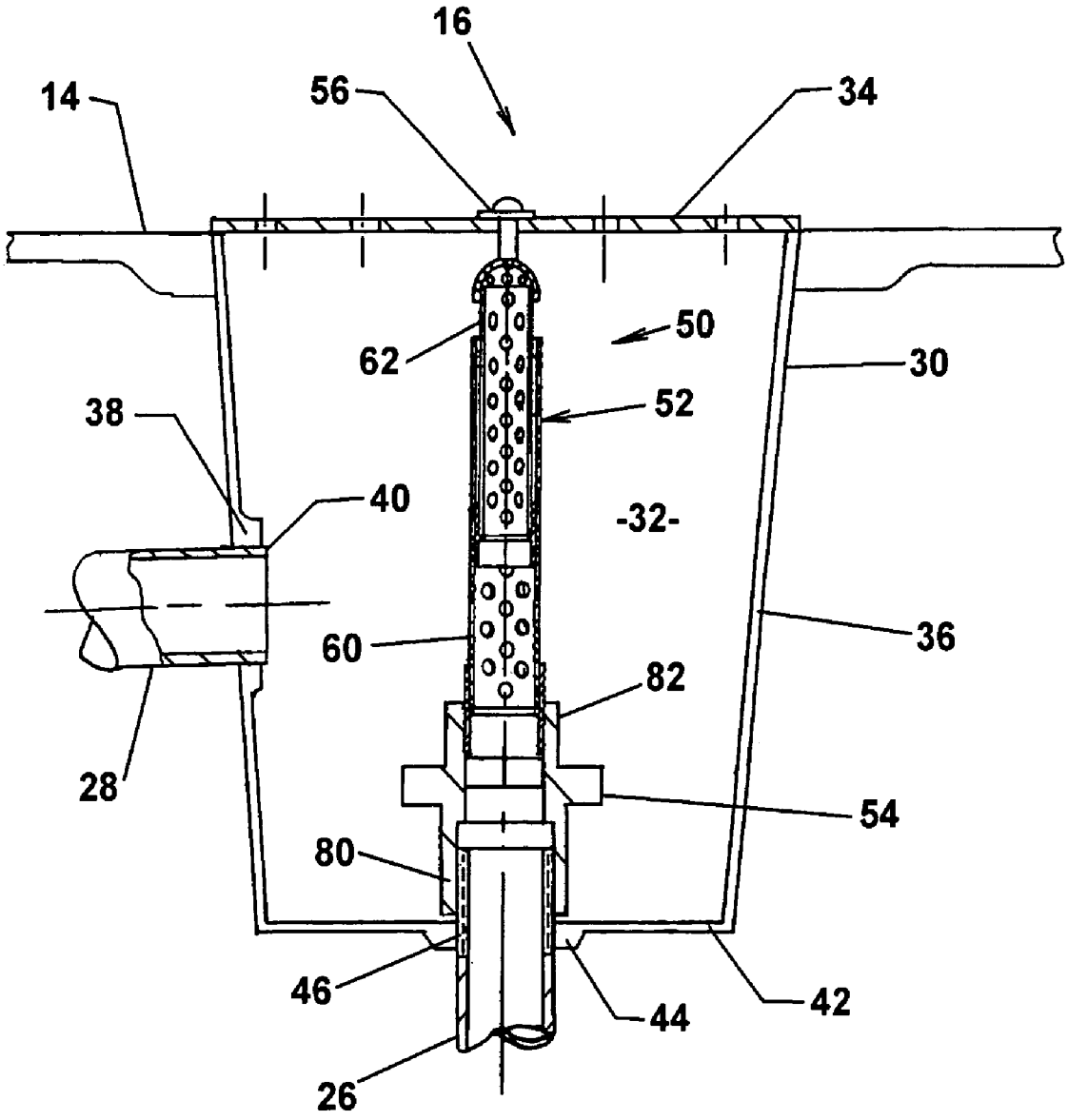
FIG. 2 is a side cross sectional view of a swimming pool main drain having a safety inlet assembly according an embodiment of the invention.

Referring to FIG. 2, a main drain 16 includes a drain body 30 having an upwardly opening cavity 32 covered by an apertured cover plate 34 or other grillwork provided with flow passages. The body 30 includes a peripheral sidewall 36 having a threaded apertured boss 38 that is coupled to the threaded end 40 of the branch conduit 28 leading to the skimmer drain 18. The body 30 includes a base 42 having a central apertured boss 44 that receives the threaded terminal end 46 of the main drain conduit 26. The foregoing is exemplary of many main drain designs, however, differing configurations are compatible with the invention. Further, the location and terminal ends of the conduits may vary from design to design, however, the coupling with the safety inlet assembly described below uses well-known commercially available components.

A safety inlet assembly 50 is mounted in the cavity 32 and includes a perforated sleeve assembly 52 having a coupling member 54 for attachment to the terminal end 46 of the main drain conduit 26. The drain cover plate 34 is attached to the upper end of the sleeve assembly 52 by fastener assembly 56 comprising a stainless self tapping screw and washer.

Figure 4:
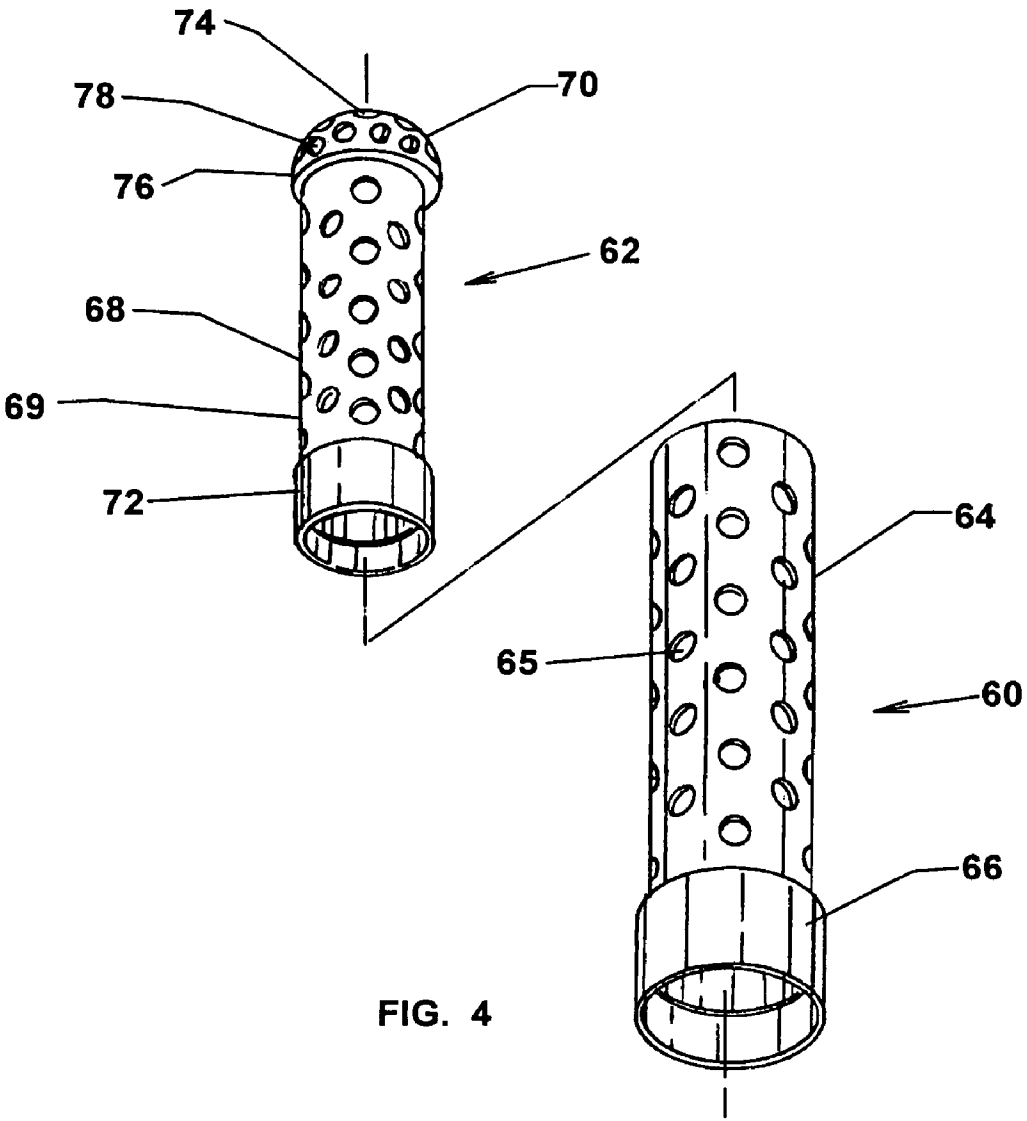
FIG. 4 is a side cross sectional view of the safety inlet of FIG. 3.
Figure 3:
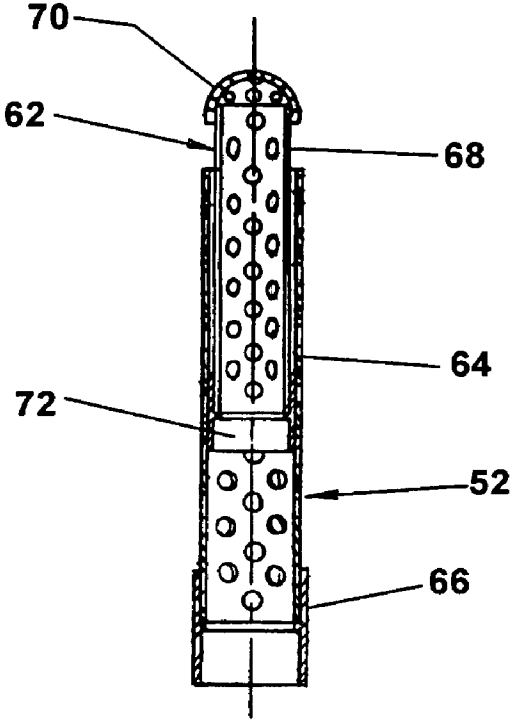
FIG. 3 is an exploded perspective view of the safety inlet of FIG. 2.

Referring to FIGS. 3 and 4, the sleeve assembly 52 comprises an outer sleeve 60 and an inner sleeve 62. The outer sleeve 60 includes a cylindrical body 64 having a plurality of axially and circumferentially spaced openings 65. A cylindrical collar 66 is attached to the lower end of the body 64. The inner sleeve 62 includes a cylindrical body 68 having a plurality of axially and circumferentially spaced openings 69, a cover cap 70 and a cylindrical collar 72 attached at the lower end thereof. The cover cap 70 has a hemispherical upper portion 74 and a lower circumferential skirt 76. The upper portion 74 of the cap 70 includes a plurality of openings 78. The sleeve bodies 64, 68, cap 70 and collars 66, 72 are preferably formed of non-corrosive materials such as plastic. Suitable flow openings in the range of ⅛ to ¼ inch are preferred.

The inner sleeve 62 is telescopically received within the outer sleeve 60. The collar 72 is sized to provide a sliding compressive fit with the inner surface of the outer sleeve 62 thereby providing for assembly with or without the cover plate 34 attached thereto (FIG. 2) while resisting inadvertent disassembly in use.

For use in a main drain of the type described above, a suitable coupling 54 includes a threaded base 80 for assembly with the threaded terminal 46 of the conduit 26, and an upper cylindrical rim 82 providing a socket for receiving the collar 66 of the outer sleeve 60. The collar 66 may be mechanically or adhesively mounted at the rim socket. For alternative non-threaded terminations of the conduit 26, other widely available coupling components may be employed for assembling the safety sleeve to the main conduit. Moreover, male or female connected for external or internal coupling at the collar 66 may be utilized.

The sleeve assembly 52 may be incorporated on existing drains by removing the existing cover plate or grill, threading the coupling 54 onto the treaded end 46, mounting the cover plate 34 over the cavity 32, and attaching the cover plate 34 to the inner sleeve 62 with fastener assembly 56. Alternatively, as described above the inner sleeve 62 may be assembled to the cover plate 34 and the unit telescopically assembled.

The openings in the sleeve assembly provide an entrance area to the main conduit substantially greater than the flow area of the main conduit 26 thereby providing an unimpeded flow rate to the pump in the event of partial obstruction. If for any reason, the cover plate 34 detaches, the safety inlet provides a three dimensional inlet that maintains full flow rates and reduces the chances that pool users and/or apparel could be dangerously sucked into the conduit 26.

Figure 5:
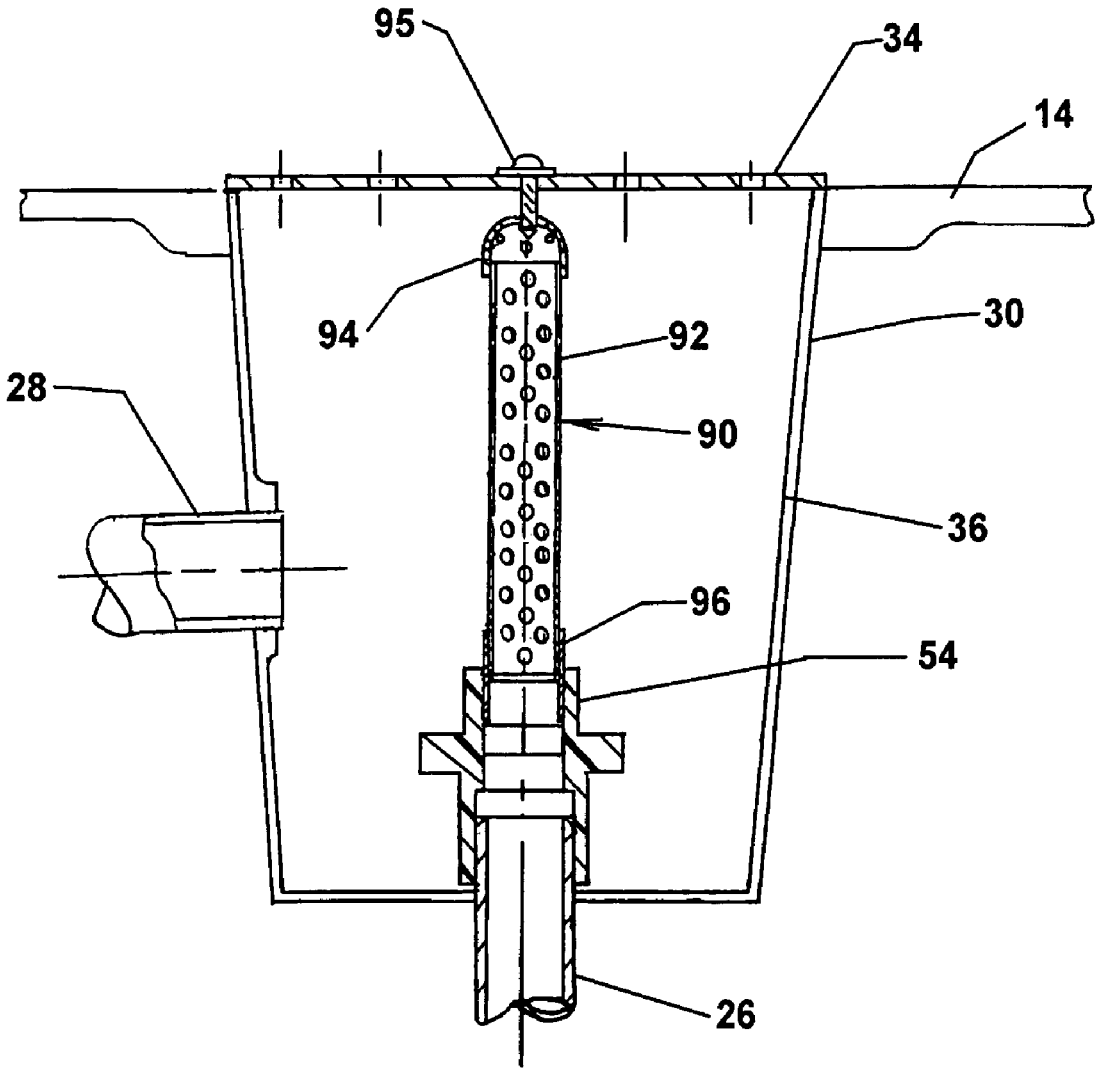
FIG. 5 is a side cross sectional view of a swimming pool main drain having a safety inlet assembly according to another embodiment of the invention.

Another embodiment is shown in FIG. 5 wherein the safety inlet assembly 90 comprises a single sleeve assembly 92 having a cap 94 attached to the cover plate 34 by fastener assembly 95, and a lower cylindrical collar 96 mounted on the coupling 54 as described above.

Figure 6:
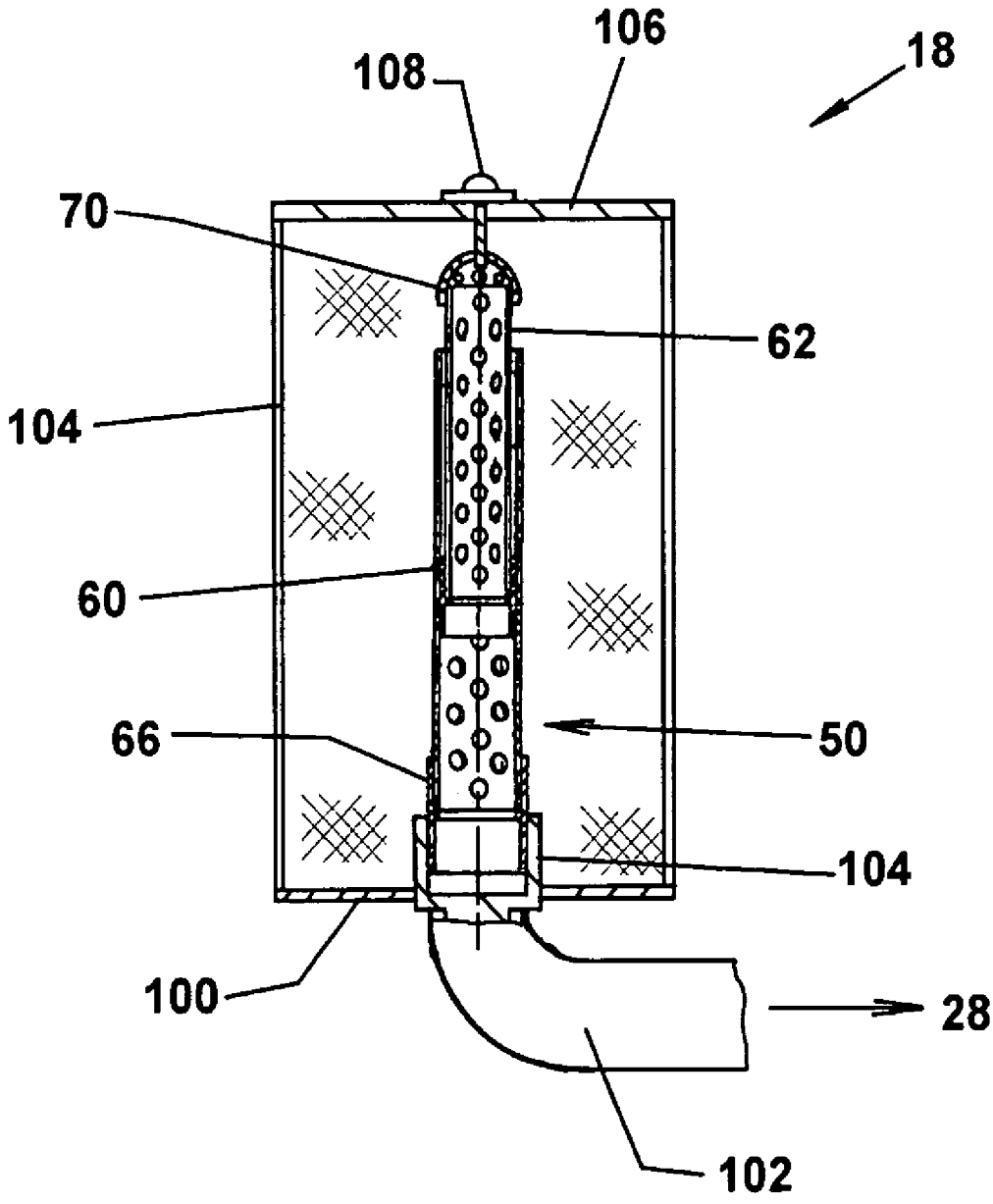
FIG. 6 is a side cross sectional view of a swimming pool skimmer drain having a safety inlet assembly in accordance with a further embodiment of the invention.

The inlet assembly 30 may also be incorporated into the skimmer drain 18 as shown in FIG. 6. Therein, the skimmer drain 18 includes a skimmer body having a circular base 100 centrally carrying a curved pre-drain pipe 102 having a socket sleeve 104 for receiving the collar 66 of the outer sleeve 60. The pipe 102 is attached as appropriate for the skimming application to the branch conduit 28. A cylindrical meshed screen 104 is carried by the base 100 defining a center cavity housing the inlet assembly 50. The top of the screen 104 is covered by a circular lid 106. The lid 106 is attached to the cap 70 of the inner sleeve 62 by fastener assembly 108.

It will be appreciated that the safety inlet assembly may be provided as desireable safety equipment for new pool installations or provided as an aftermarket kit for the replacement market. In both applications, the safety inlet assembly may be readily integrated with conventional designs using widely available coupling components.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. In a pool installation having a reservoir supplied with water from a pump in a supply line and returned to the pump in a return line having a terminal end, a drain assembly including said terminal end comprising: a drain body member having a peripheral wall defining a upwardly opening cavity; aperture means on said drain body member for receiving into said cavity said terminal end; a cover member overlying peripheral wall and said cavity; a coupling member connected to said terminal end of said return line, said coupling member including an upwardly opening socket in fluid communication with said terminal end of said return line; a sleeve assembly including a first cylindrical sleeve member including a plurality of apertures therein; a cylindrical first collar connected to a lower end of said first sleeve member; a cap member covering an upper end of said sleeve assembly, said collar being received in said upwardly opening socket and connected to said coupling member; and fastener means connecting said cover member to said cap member; and flow control apertures in said drain body member for allowing water flow into said cavity, through said sleeve assembly into said terminal end of said return line, said sleeve assembly precluding complete obstruction of said flow control apertures in the event said cover member becomes displaced.

2. The drain assembly as recited in claim 1 wherein said flow control apertures are formed in said cover member.

3. The drain assembly as recited in claim 2 wherein said terminal end is threaded end and said coupling member includes a threaded lower end connected thereto.

4. The drain assembly as recited in claim 3 wherein said cap member is apertured and domed shaped.

5. The drain assembly as recited in claim 4 wherein an apertured second sleeve member is telescopically received within said first sleeve member and a said cap member is connected to an upper end of said second sleeve member.

6. The drain assembly as recited in claim 5 wherein a second collar connected to a lower end of said second sleeve member and having a sliding compressive fit with said first sleeve member whereby said second sleeve member and said cover member can be telescopically assembled onto said first sleeve member.

7. The drain assembly as recited in claim 6 wherein said body member comprises a skimmer drain having a peripheral wall provided with said aperture means.

8. The drain assembly as recited in claim 7 wherein said terminal end of said return line is an angled pipe.

9. The drain assembly as recited in claim 1 wherein said drain body includes a branch conduit fluidly communicating with a skimmer drain.

* * * * *